US005172584A

United States Patent [19]

Thomas

[11] Patent Number: 5,172,584

[45] Date of Patent: Dec. 22, 1992

[54] SECONDARY CONTAINMENT AND LEAK DETECTION APPARATUS

[75] Inventor: Horace F. Thomas, Houston, Tex.

[73] Assignee: CoreTank, Inc., Houston, Tex.

[21] Appl. No.: 634,324

[22] Filed: Dec. 26, 1990

Related U.S. Application Data

[63] Continuation-in-part of Ser. No. 509,246, Apr. 9, 1990, Pat. No. 5,096,087, which is a continuation-in-part of Ser. No. 388,593, Aug. 2, 1989, Pat. No. 4,939,833.

[51] Int. Cl.[5] ..... G01M 3/32

[52] U.S. Cl. ..... 73/49.2; 220/565

[58] Field of Search ..... 73/49.2, 40.5 R; 220/565, 466, 469, 855, 85 VR, 85 VS

[56] References Cited

U.S. PATENT DOCUMENTS

| | | | |
|---|---|---|---|
| 2,924,352 | 2/1960 | Santner et al. | 73/49.2 X |
| 3,902,356 | 9/1975 | Rupf-Bolz | 73/49.2 |
| 4,682,492 | 7/1987 | Green | 73/40.5 R X |
| 4,840,283 | 6/1989 | Lillywhite et al. | 220/469 X |
| 4,918,978 | 4/1990 | Green | 73/49.2 |

FOREIGN PATENT DOCUMENTS

| | | | |
|---|---|---|---|
| 2063147 | 8/1971 | Fed. Rep. of Germany | 220/565 |
| 240358 | 10/1986 | Fed. Rep. of Germany | 73/49.2 |

*Primary Examiner*—Hezron E. Williams
*Assistant Examiner*—Joseph W. Roskos
*Attorney, Agent, or Firm*—Harrison & Egbert

[57] ABSTRACT

An apparatus for holding stored material and for containing and detecting leaks of the stored material from the apparatus having a tank, a containment baffle, and a leak detection system. The tank includes a tank bottom having a continuous surface for supporting the stored material. A shell surrounds such stored material. The shell is disposed above the continuous surface of the tank bottom in continuous sealing contact therewith. The containment baffle is a baffle plate having a continuous surface for supporting the stored material. The baffle plate is disposed above the tank bottom and within the shell. The baffle plate is in continuous sealing contact with the shell so as to form a containment space between the baffle plate and the tank bottom. The baffle plate is rigidly supported above the tank bottom. A fill of aggregate material is interposed between the baffle plate and the tank bottom for structural support of the baffle plate. The leak detection system is isolated from the aggregate material within the containment space for detecting and sending signals in response to the presence of a stored material within the containment space.

17 Claims, 7 Drawing Sheets

SECONDARY CONTAINMENT AND LEAK DETECTION APPARATUS

RELATED APPLICATIONS

The present application is a continuation-in-part application of U.S. Pat. No. 5,096,087, issued on Mar. 17, 1992 and entitled "Double Containment and Leak Detection Apparatus". U.S. patent application Ser. No. 07/509,246 is a continuation-in-part application of U.S. Pat. No. 4,939,833, issued on Jul. 10, 1990, and entitled "Double Containment and Leak Detection Apparatus".

BACKGROUND OF THE INVENTION

The present invention relates to means for containing and detecting leaks in storage tanks. More particularly, the present invention relates to apparatus and methods for constructing such apparatus, for containing multiple or repeated leaks of hazardous, polluting, or otherwise undesirable fluids or solids from storage tanks, and for quickly detecting and signaling the presence of such leaks, thereby minimizing the dangers posed by storing such fluids and solids and complying with regulations requiring such containment and detection.

Storage of hazardous liquids and solids used in numerous industries requires storage tanks of all sizes. Chemical process plants, refineries, oil and gas production sites, manufacturing plants, and the like require storage of a variety of materials for processes used in such facilities. The materials so stored, whether gases, liquids, or solids, may include chemicals and compounds that could endanger the environment or pose significant health risks in the event of leakage into areas surrounding these storage systems. Heightened awareness in recent years over the quality of the environment has increased and tightened the rules, regulations, and requirements governing storage of such materials. Growing concern with public health issues has further emphasized the need to prevent leakage of hazardous materials into the environment to prevent, for leakage, contaminating drinking water or exposing humans or wildlife to hazardous compounds.

Among the regulations governing the storage discussed above, by way of example, are the rules promulgated by the Environmental Protection Agency ("EPA") for hazardous waste management systems. See, e.g., 40 C.F.R. §§260-65 and §268 (1988). The EPA rules govern, among other matters, tank systems that store hazardous wastes. Id., §260.10. Hazardous wastes subject to these regulations include a host of residues, byproducts, and wastes that are generated or used in any of a lengthy list of chemical, manufacturing, and other processes. Id., §§261.3-ff. Under these regulations what is designated "secondary containment" must be provided on all new tank systems storing hazardous wastes, and on existing hazardous waste systems as of various effective dates subsequent to Jan. 12, 1987. See id., §264.193 and §265.193. Such a secondary containment system must permit spilled or leaked waste to be detected in that secondary containment system within twenty-four (24) hours (or as timely as possible) after a spill or leak. Id. Furthermore, the EPA regulations deem a tank system "unfit for use" if it is no longer capable of storing or treating hazardous wastes without itself posing a threat of release of hazardous waste to the environment. Id., §260.10. Finally, the EPA regulations require that any hazardous waste materials released into a secondary containment system must be removed within twenty-four hours, or in as timely a manner as is possible. Id., §264.196. The tank system cannot be used until the released waste is removed and any necessary repairs to the system are made. (Although reference is made in the present application to EPA regulations and the definitions used in those regulations, those definitions are not intended to, and do not, generally govern the use of terms in this application. Except as may be expressly noted to the contrary, all terms used in this application are to have their common and accepted means.)

Therefore, an acceptable secondary containment system under these EPA regulations must, in general terms, be capable of collecting and accumulating liquids that leak from a tank, detecting such a leak or the presence of the accumulated liquids in the system, and permitting removal of such liquids, all within twenty-four (24) hours of the leak. Id. As can be seen, therefore, the EPA regulations, as well as increasing safety and health concerns, have imposed stringent requirements for containing, detecting, and removing leakage of hazardous materials from storage tank systems. Effective, economical, and safe double containment and leak detection systems, therefore, are not only desirable but also mandatory, both for new and existing tank systems.

The cost of building new systems or converting old systems to comply with the EPA regulations could be astronomical if not performed with a minimum of alteration to tank systems built under previous requirements. Prior attempts at meeting the EPA regulations have encountered problems and proven unsatisfactory, for a variety of reasons. For example, various plastic liners, both internal and external, have been used in trying to meet the secondary containment requirement of the EPA regulations. Such liners, however, have split at their seams and would lead to contamination of the soil in the event of external tank leaks. Since liner systems do not form a sealed containment space, it is virtually impossible to inspect or test the integrity of the liner systems. To meet the requirements for removal of wastes, the contaminated soil then has to be removed and disposed of, which requires either removing the tank bottom or lifting the entire tank, to permit digging up the soil. This process of lifting or dismantling the tank and removing soil (which generally needs to be replaced) is very expensive and time-consuming. Another unsuccessful attempt to meet the EPA secondary containment regulations has utilized double-walled and double-bottom tanks, generally made of steel, with the annular space between the walls and bottoms filled with sand or other filler material. This latter technique has also proven to be unacceptable, because it fails to allow for removing, cleaning, and disposing the filler material should a leak occur.

It can be seen, therefore, that a need exists for meeting EPA regulations and satisfying environmental and safety concerns in general by providing economical, effective, and reliable double containment and leak detection system for storage tanks, for both new and existing storage tanks.

U.S. Pat. No. 4,939,833, issued on Jul. 10, 1990, to the present inventor, describes such a double containment and leak detection system. In this invention, a plurality of baffle supports are provided so as to maintain a baffle plate in a proper position above the tank bottom. These baffle supports are disposed in a generally parallel fashion on the upper surface of the tank bottom. Each baffle support is placed on the upper surface of the tank bottom with the opposite ends of each baffle support located adjacent to points on the interior periphery of the shell. It was indicated in this patent that it could be readily seen by those skilled in the art that a variety of techniques and materials could be used to provide adequate structural support for the baffle plate so long as the baffle plate is supported sufficiently to bear the weight of the materials to be stored within the tank body without undue or impermissible stress or deflection. After experimentation, it was found that, for large tanks, a large number of the steel structural members would be required to provide the necessary structural support. It was found that, although these provide a superior support for the baffle plate, it was relatively costly. As such, it was felt to be important to accommodate the needs of secondary containment and leak detection in low cost applications.

It is an object of the present invention to provide a baffle plate support system that is inexpensive and easy to utilize.

It is another object of the present invention to provide a baffle plate support system that is compatible with leak detection.

It is still a further object of the present invention to provide a leak detection system that can be used in the containment space between the baffle plate and the tank bottom.

These and other objects and advantages of the present invention will become apparent from a reading of the attached specification and appended claims.

SUMMARY OF THE INVENTION

The present invention is directed to providing a means for secondary containment and leak detection that effectively and inexpensively satisfies EPA regulations and provides superior and safe control and detection of leaks from storage tanks. The present invention enables effective, yet relatively inexpensive, conversion of new or existing storage tanks to provide a secondary containment system that permits containing, accummulating, and detecting the presence of fluids or solids that might leak from the primary containment space in such tanks into a containment space provided by the present invention.

The present invention is an apparatus for holding stored material and for the containing and detecting of leaks of such stored material. This apparatus comprises a tank, a containment baffle, and a leak detection system. The tank includes a tank bottom having a continuous surface for supporting the stored material. It also includes a shell for surrounding such stored material. The shell is disposed above the continuous surface of the tank bottom and is in continuous sealing contact therewith. The containment baffle includes baffle plate having a continuous surface for supporting the stored material. The baffle plate is disposed above the tank bottom and within the shell. The continuous surface of the baffle plate is in continuous sealing contact with the shell so as to form a containment space disposed between the baffle plate and the tank bottom. The baffle plate is supported above the tank bottom. As such, the baffle plate is supported by a fill of aggregate material contained within the containment space. The leak detection system is suitable for detecting and sending signals in response to the presence of stored material within the containment space.

As used herein, the term "aggregate material" includes sand, gravel, porous organic matter, and any combination thereof.

The leak detection system is connected to a device external of the tank for receiving and sending signals to the leak detection system. Specifically, the leak detection system comprises a probe and a barrier member. The probe is responsive to the presence of the stored material within the containment space. The barrier is positioned between the probe and the aggregate material in the containment space. The barrier separates the probe from the aggregate material. The barrier also permits the probe to sense the presence of the stored material.

Specifically, the barrier/probe combination has many embodiments. One of the embodiments is a perforated or serated material or mesh material that is fastened to the probe so as to surround one end of the probe. Another embodiment is a screen (or any material or structural design that separates the flow of aggregate material from the probe while permitting the flow of the starch material) that is fastened to the baffle plate and is fastened to the tank bottom. The screen defines in a compartment within the containment space. The probe is positioned within this compartment on the opposite side of the screen from the aggregate material. As such, the aggregate material is segregated from the probe.

Another embodiment is the use of a structural member that is formed within the containment space. A screen is affixed to this structural member at a position beyond the end of the probe. The structural member extends beyond the end of the probe and is interposed between the baffle plate and the tank bottom. The aggregate material resides on the side of the screen opposite the probe. A mesh is fastened to the probe so as to surround an end of the probe. In its various embodiments, the structural member can comprise a cylindrical member that is affixed to the top surface of the tank bottom. It can also comprise a pair of vertical walls disposed on each side of the probe. It can further comprise a tubular casing that extends around the probe and is affixed at one end to the shell.

The present invention further provides a method for converting existing tanks simply and inexpensively so as to incorporate the double containment and leak detection system of the present invention. Specifically, prior to the installation of the containment baffle, a fill of aggregate material is introduced onto the top surface of the tank bottom. As such, the aggregate material will support the containment baffle during installation and use.

Along with the aggregate material, the containment space can also receive an inert gas, such as nitrogen, for the purposes of inhibiting corrosion in the containment space.

DETAILED DESCRIPTION OF THE INVENTION

Modern chemical and manufacturing processes require storage of a variety of hazardous, dangerous, or otherwise undesirable materials. Concern for protection of the environment, awareness of health risks, and increasingly stringent regulations and laws dictate a need for improved protection against accidental or uncontrolled leakage of such materials from storage. In particular, Environmental Protection Agency regulations require that all storage systems, both new and existing, have or soon be equipped with secondary containment systems that are capable of collecting, accumulating, and detecting leakage of hazardous wastes from the primary containment system. Storage systems must also permit removal of hazardous waste material that leaks or spills into the secondary containment system, so the entire system can be restored to the original condition that existed before such leak or spill. The present invention, an embodiment of which is described below, is intended to provide apparatus for achieving such containment and detection of leaks from storage tank systems.

Figure 1:
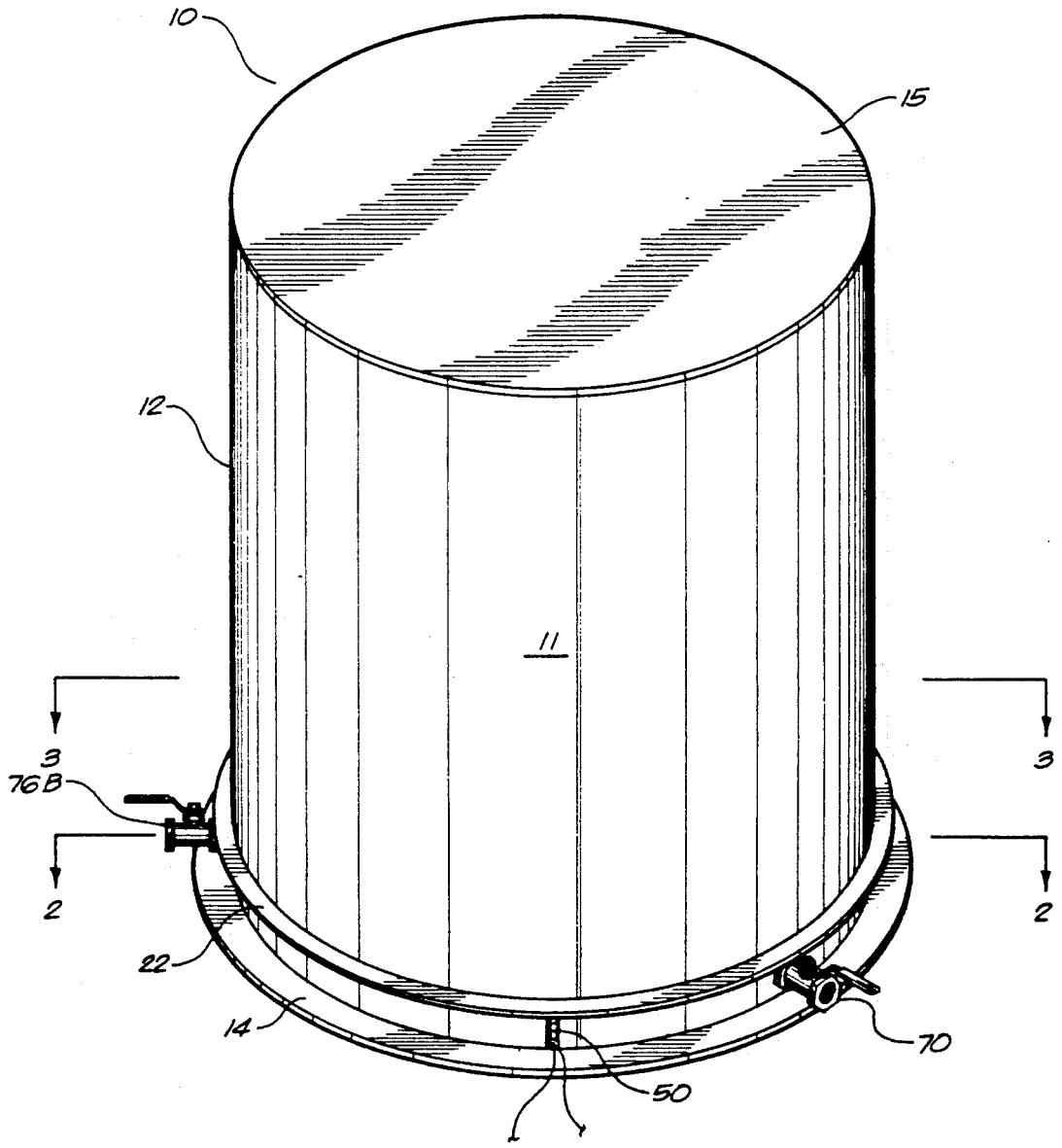
FIG. 1 shows an overall perspective view of a storage tank built in accordance with, and utilizing, the principles of the present invention (with various details omitted for clarity)

With reference to FIG. 1, there is shown therein a tank system 10 utilizing a double containment and leak detection apparatus built according to the present invention. The tank system 10 includes a tank body 11 having a shell 12 extending above a bottom 14. The shell 12 and bottom 14 are sealingly connected to form a container for storing, by way of example, liquids, in the embodiment shown. The present invention also is suitable for use on tanks for storing gases or solids, as the case may be. In the embodiment shown in FIG. 1 the tank system 10 includes top a 15 for covering the interior of the tank body 11. It is also within the scope of the invention to utilize a tank system 10 that lacks such a top 15 with containment and detection of leaks from the lower portions of the tank system 10.

Figure 2:
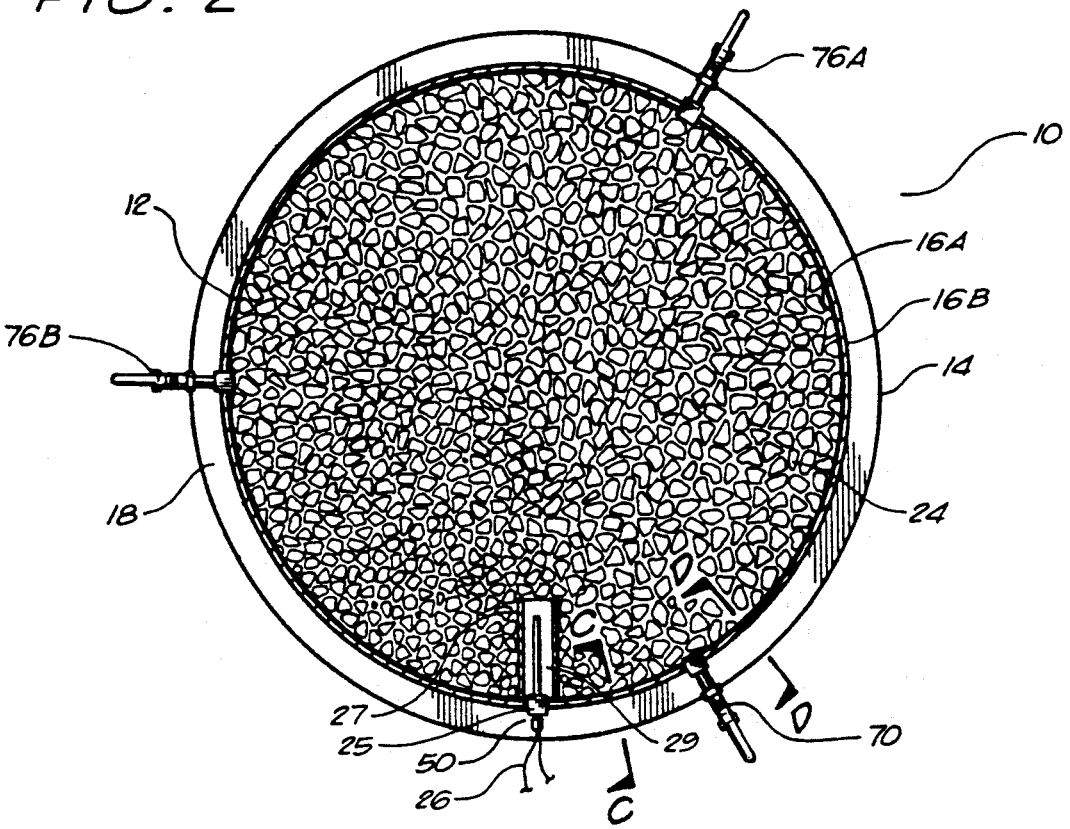
FIG. 2 shows a cross-sectional plan view of the tank shown in FIG. 1, viewed across line A—A of FIG. 1.

Referring now to FIG. 2, there is shown therein a cross-sectional plan view along line A—A of FIG. 1, depicting various details omitted for clarity from FIG. 1. As can be seen in FIG. 2, the shell 12 is generally circular in cross-section, although another appropriate shape would be suitable for purposes of the present invention. The base of the shell 12 in the depicted embodiment rests on the upper surface 18 of the bottom 14. The junction between the shell 12 and the bottom 14 is sealed on the interior and exterior periphery by an interior weld 16A and a exterior weld 16B, respectively, both of which are continuous welds and are shown in more detail in FIG. 9 described below. With the shell 12 thus in continuous sealing contact with the bottom 14, the tank body 11 can hold materials within its interior. (Other elements depicted in FIG. 2 are discussed in more detail below.)

Figure 3:
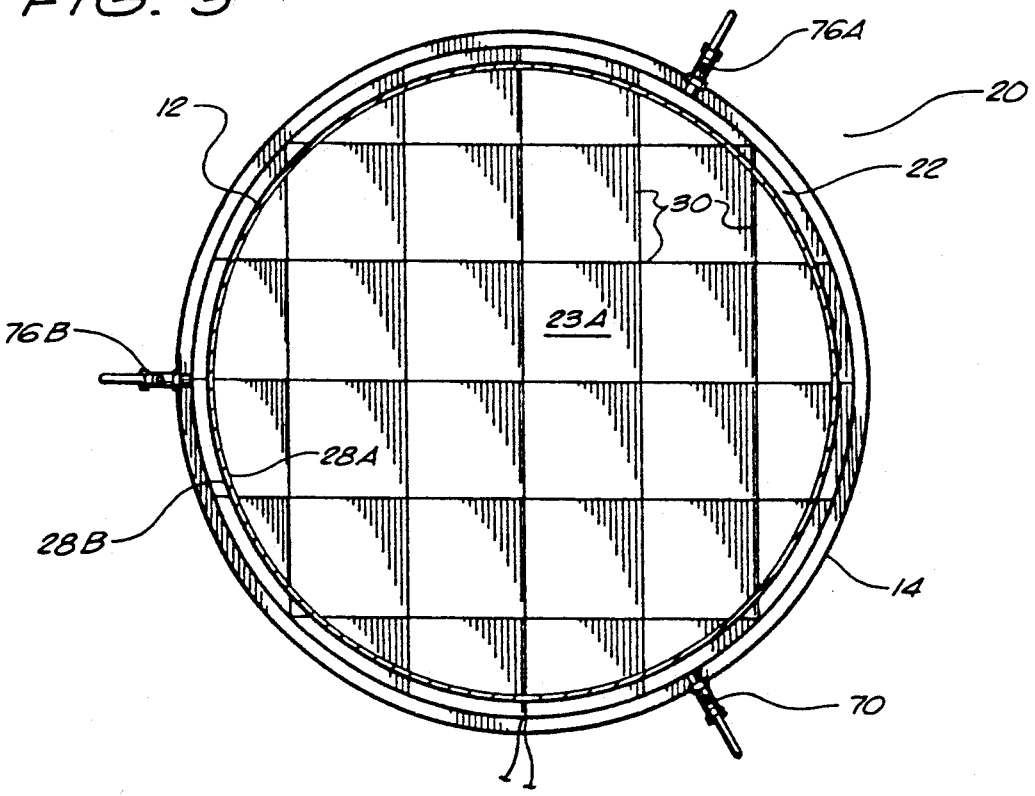
FIG. 3 shows a cross-sectional plan view of the tank shown in FIG. 1 viewed across line B—B of FIG. 1.
Figure 9:
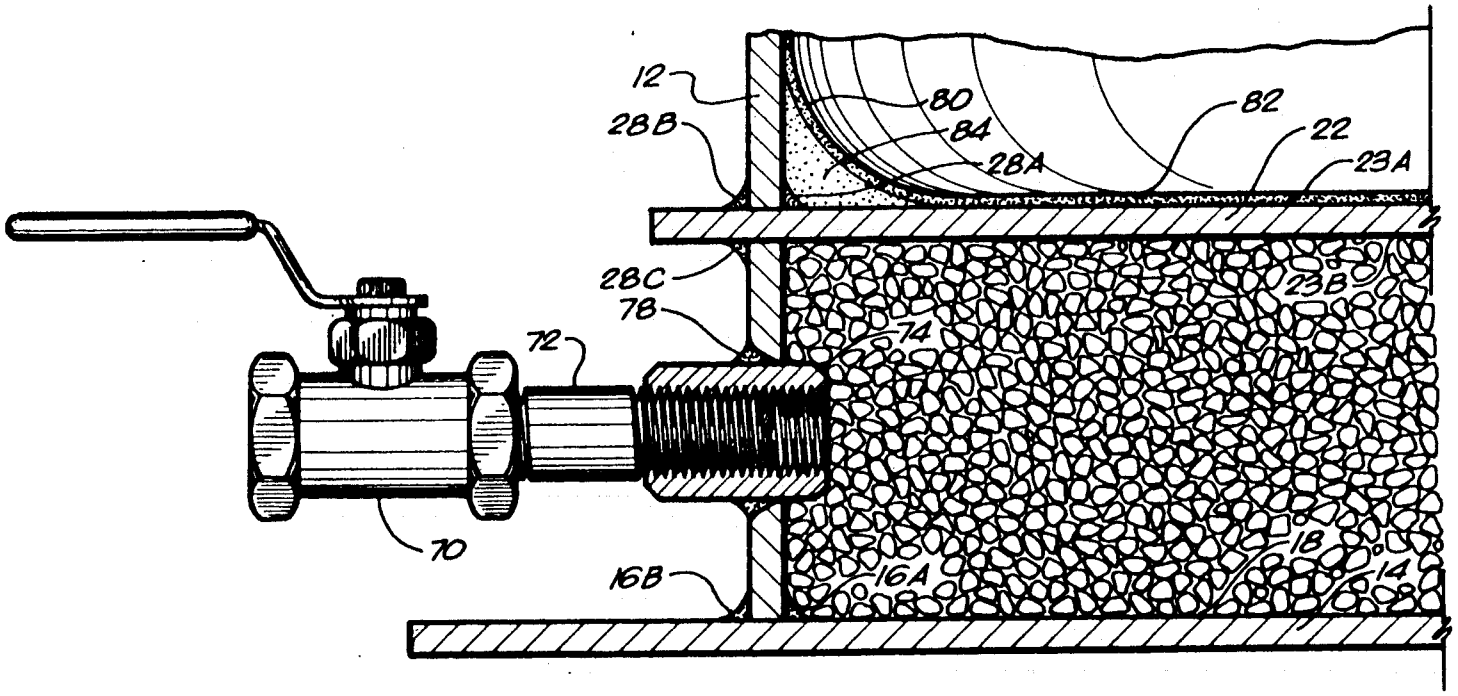
FIG. 9 shows a partial cross-sectional elevational view of a portion of the tank of FIG. 2, taken along the line D—D of FIG. 2.

With reference now to FIG. 3, there is shown therein a cross-sectional plan view taken through line B—B of FIG. 1, in which elements of the containment baffle means 20 of the present invention are shown. The shell 12, shown in cross-section, is generally perpendicular to and extends above a baffle plate 22, which is above and substantially parallel to the bottom 14, and has upper and lower surfaces 23A and 23B, respectively. The baffle plate 22 is in continuous sealing contact with the interior surface of the shell 12 by means of a baffle interior weld 28A disposed about the interior periphery of the shell 12 where it meets the baffle plate 22. In the embodiment shown, the baffle plate 22 extends outside the exterior of the shell 12, although such arrangement is not necessary for purposes of the present invention. (As discussed below, the embodiment depicted herein envisions insertion of the baffle plate 22 into an existing tank body 11, which is facilitated by the particular construction of the baffle plate 22 shown.) In the embodiment depicted in FIG. 3, the baffle plate 22 is actually constructed from smaller plates joined together into one larger plate by means of interconnecting lap or butt welds 30, some of which are depicted in FIG. 3. To ensure structural integrity and sealing contact, the baffle plate 22 is joined to the exterior of the shell 12 by welds between the exterior of the shell 12 and the portion of the baffle plate 22 extending outside the shell 12. Upper baffle exterior weld 28B, on the upper surface 23A of baffle plate 22, is shown in FIG. 3; lower baffle exterior weld 28C, on the lower surface 23B of baffle plate 22, and upper baffle exterior weld 28B are depicted in FIG. 9, discussed below.

With reference again to FIG. 2, the embodiment described herein includes a fill 24 of aggregate material that is distributed over the upper surface 18 of bottom 14 of the tank bottom 10. This aggregate material 24 may be either sand, gravel, porous organic matter, or a combination of these materials. Various other types of aggregate material or supporting material can also be used for the purposes of the fill 24. This fill 24 provides structural support for the baffle plate 22 shown in FIG. 3. The fill 24 is introduced into the area of the upper surface 18 of bottom 14 during the assembly of the tank system of the present invention. Specifically, this fill 24 is provided prior to the installation of the baffle plate 22.

In FIG. 2, it can be seen that the leak detection system 50 includes a probe 25 that extends through the shell 12 of tank system 10. This probe 25 includes connections 26 that are connected to a device external of the tank system 10 for receiving and sending signals to the probe 25. It can be seen that a barrier 27 surrounds the probe 25 so as to isolate the probe 25 from the surrounding fill 24 of aggregate material. As will be described hereinafter, the barrier 27 is suitable for preventing the intrusion of the aggregate material 24 into the compartment 29. The barrier 27 should also be suitable for allowing the probe 26 to suitably detect the presence of any liquid or solid that has leaked through the baffle plate 22 into the aggregate fill 24.

Figure 4:
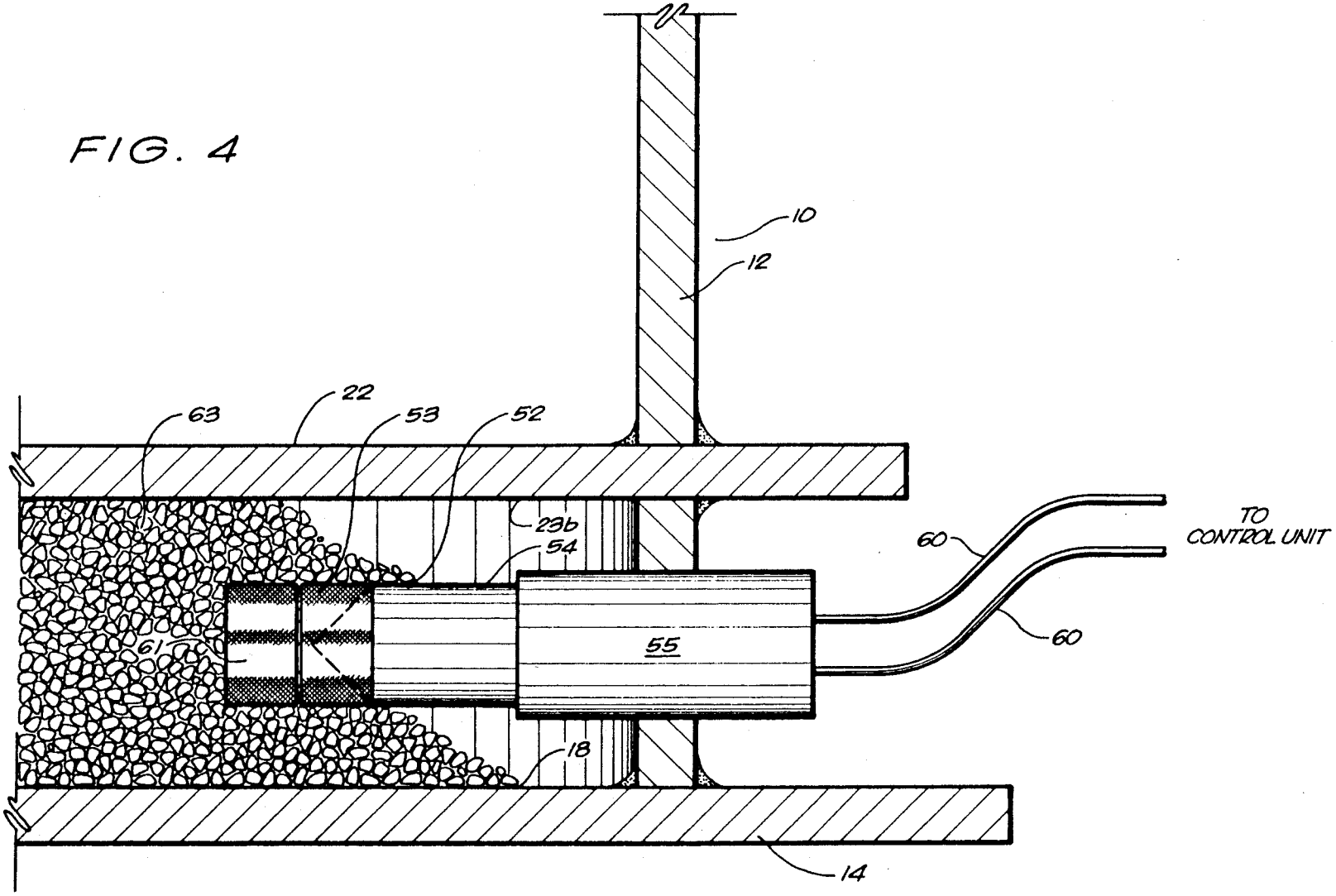
FIG. 4 shows an isolated cross-sectional view taken across line C—C of FIG. 2, showing an embodiment of the probe/barrier combination.

The present invention provides for including a leak detection means 50 above the bottom 14 and below the baffle plate 22. FIG. 4 illustrates a probe 52 extending through the wall of shell 12 into a space designated the containment space located above the upper surface 18 of the bottom 14 and below the bottom surface 23B of baffle plate 22. As shown in FIG. 4, the probe 52 has a probe tip 53 that extends into the containment space while the opposite end of the probe tip 53 joins the probe body 54 that extends through the shell 12 to the exterior of tank body 11. The probe body 54 thus extends from the containment space in the interior of shell 12 to the exterior of shell 12. Suitable means should be provided so as to create a liquid-proof seal on the exterior of shell 12 around the outer periphery of the coupling 55. Probe leads 60 extend from coupling 55. These probe leads 60 are connected so as to extend beyond the tank system 10 to an appropriate signalling, warning, process control, or other device capable of receiving and responding to signals transmitted by the probe 52.

Figure 5:
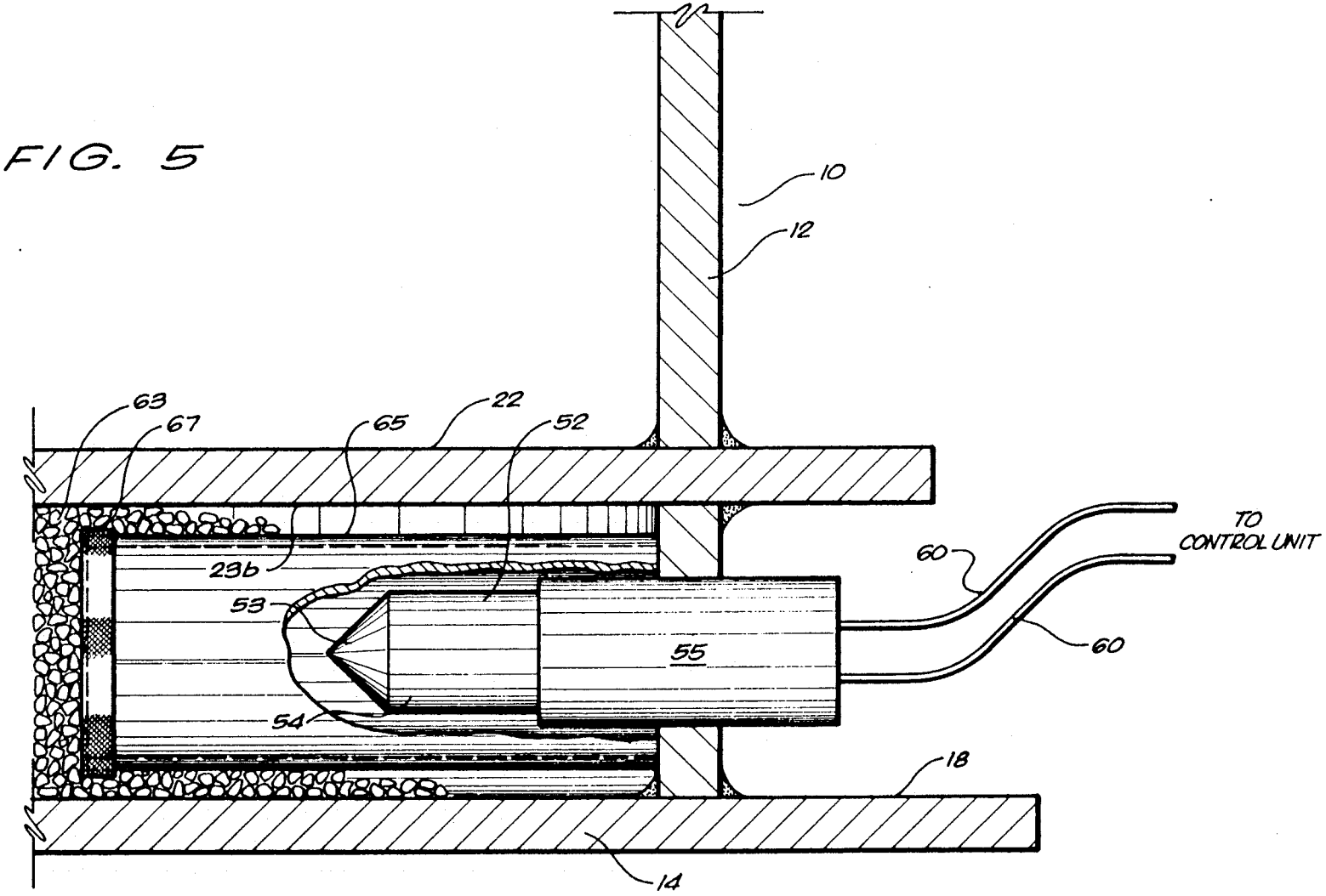
FIG. 5 is a partial cross-sectional view showing another embodiment of the probe/barrier combination as taken across line C—C of FIG. 2.

The preferred embodiment shown includes the fiber optic probe 52 for use in the leak detection means 50. One acceptable fiber optic probe 52 that can achieve the purposes of the present invention, and which is generally depicted in FIG. 5, is Enraf-Nonius Series 748 available from Enraf-Nonius Tank Inventory Systems, Inc., of Stafford, Tex. The fiber optic probe 52 detects the presence of material that leaks into the containment space by emitting and detecting an optical signal. The optical signal is emitted through a prism and the fiber optic probe 52 detects the refracted optical signal. When material is introduced into the containment space, and travels or migrates to the proximity of the fiber optic probe 52, the refractive index of the prism is altered, and hence the nature of the detected optical signal changes. The fiber optic probe 52 detects such change in the optical signal and sends an electrical signal in response to detecting such change. The electrical signal can be sent, for example, to a controller device (not shown), such as the Enraf-Nonius Systems Remote Control Unit Series 744, also available from Enraf-Nonius Tank Inventory Systems, Inc. Levelite Model 11-540, also available from Arizona Instrument Company of Jerome, Ariz. The combination of the fiber optic probe 52 connected to the external controller, therefore, is able to detect and react to the presence of material, particularly fluids, that may leak into the containment space.

Other devices can serve as suitable leak detection means 50, besides the fiber optic probe 52. For example, for detecting the hydrostatic pressure of fluids leaked into the containment space from the interior of the tank body 11, a suitable pressure-sensing device is Model M-3010 (Photo Helic) manufactured by Dwyer Instrument Co. of Michigan City, Ill. As another example, for detecting the presence of solids or gases within the containment space, a "sniffer" device such as Soil Sentry Twelve, available from Arizona Instrument Company of Jerome, Ariz., can be used to detect the presence of chemicals contained in certain materials in the containment space that are held in storage in the shell 12 above the baffle plate 22. Other devices would be suitable for use in the leak detection means 50 of the present invention in addition to those mentioned above, as will be apparent to those skilled in the art. As examples, devices as simple as valves or sight glasses would enable visual or mechanical detection of the presence of liquids or gases in the containment space, and could thus be used in the leak detection means of the present invention.

In the embodiment of the present invention, FIG. 4 shows a desired way of maintaining the probe 52 within the containment space of the tank system 10. As can be seen, a barrier 61 surrounds the probe tip 53 of probe 52. Barrier 61, in the embodiment of FIG. 4, is a wire mesh material that extends about and surrounds the probe tip 53. As such, the wire mesh 61 serves to isolate the probe 52 from the aggregate material 63 located in the space between the containment baffle 22 and the tank bottom 14. As such, the probe tip 53 can perform without undue interaction of the aggregate 63. As such, the probe 52 can detect the presence of fluids as they are mixed with the aggregate 63 within the containment space.

FIG. 5 shows an alternative embodiment of the tank system 10 in accordance with the present invention. In the embodiment of FIG. 5, the probe 52 extends through the shell 12 in the manner described in conjunction with FIG. 4. The barrier between the probe 52 and the aggregate material 63 is somewhat different in the embodiment of FIG. 5. As can be seen, a tubular casing 65 extends around the probe 52. This tubular casing is affixed at one end to the inner wall of shell 12. This tubular casing 65 is a structural member which is positioned between the bottom surface 23B of baffle plate 22 and the top surface 18 of tank bottom 14. The tubular casing 65 extends entirely around the exterior of the coupling 55, the probe body 54, and the probe tip 53. A screen 67 is affixed to the end of the tubular casing 65 beyond the end of the probe 52. The aggregate material 63 is located on the opposite side of the screen 67 from the probe 52. As such, the screen 67 serves to isolate the probe 52 from the aggregate material 63 within the containment space of the tank system of the present invention. It should be noted that the embodiment in FIG. 5 can also include the protective mesh 61 (as shown in FIG. 4) around the probe 53.

Figure 6:
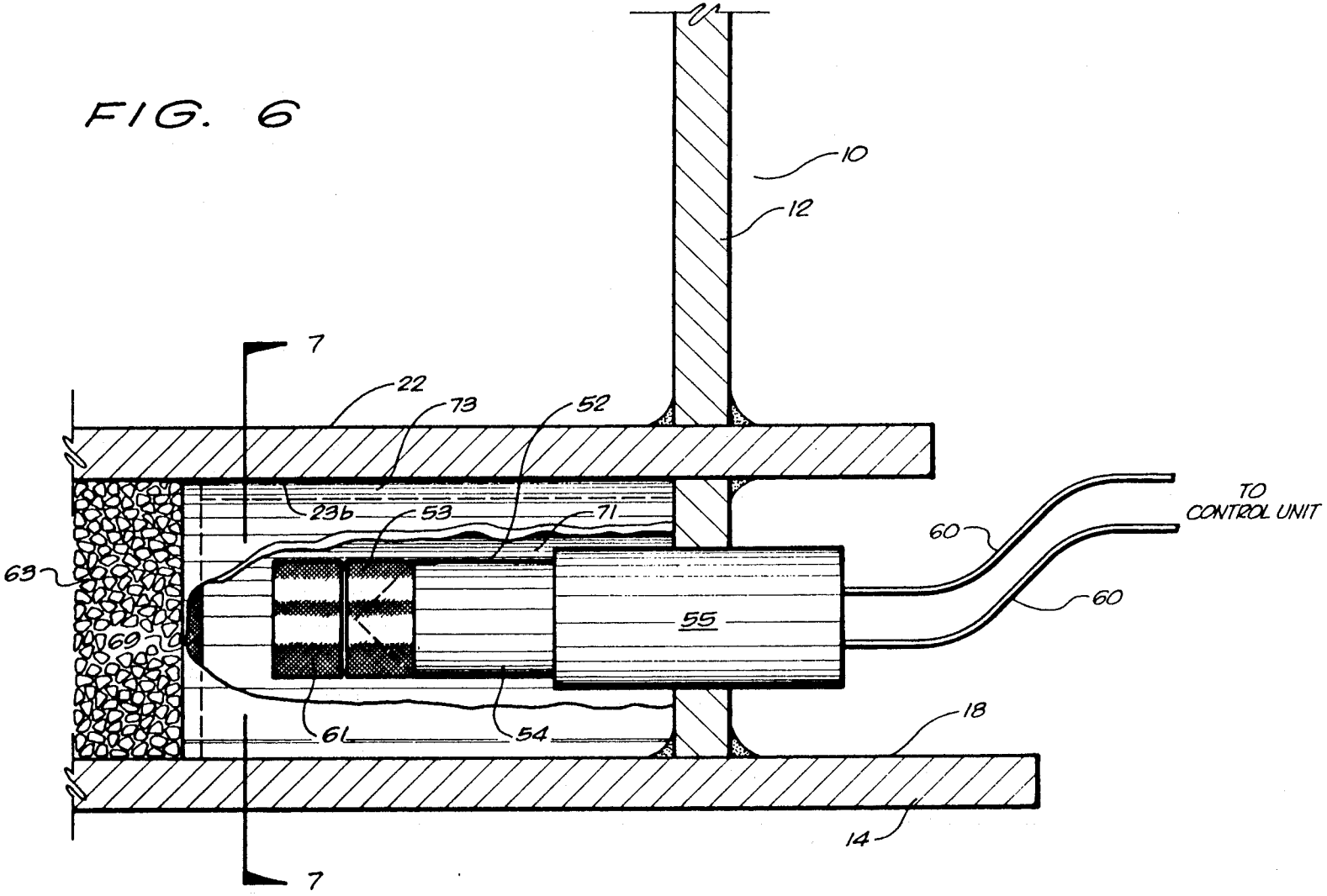
FIG. 6 is a partial cross-sectional view of another embodiment of the probe/barrier combination as taken across line C—C of FIG. 2.

FIG. 6 shows another embodiment of the leak detection system of the present invention. In this embodiment, the probe tip 53 is surrounded by the mesh 61. Also, the probe tip 53 is isolated from the aggregate 63 by the use of a screen 69. In this embodiment, the screen 69 is connected at one end to the bottom surface 23B of baffle plate 22 and is attached at the other end to the top surface 18 of tank bottom 14. A compartment 71 is thereby formed by this separation of the aggregate 63 from the probe 52.

Figure 7:
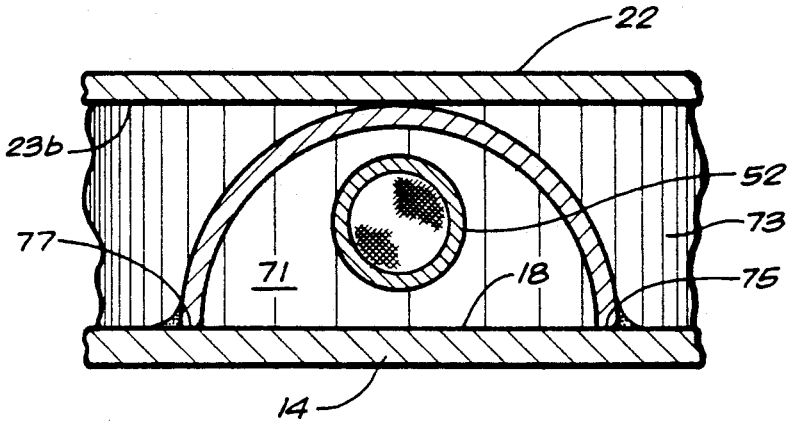
FIG. 7 is a detailed end view taken across line E—E of FIG. 6.
Figure 8:
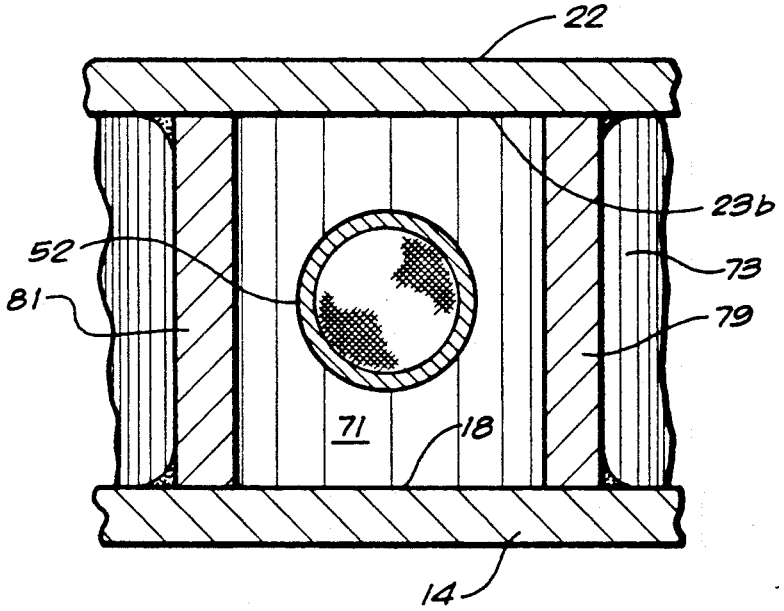
FIG. 8 is a detailed end view as taken across line E—E of FIG. 6 showing an alternative embodiment of the probe/barrier combination.

It can be seen in FIG. 6, in dotted line fashion, that a structural member 73 extends in close juxtaposition to the bottom surface 23B of baffle plate 22. It can be seen that this structural member 73 extends from the inner wall of shell 12 to beyond the end of the probe 52. FIGS. 7 and 8 show two alternative configurations for this structural member 73.

In FIG. 7, a view taken across line E—E of FIG. 6 shows the arrangement of the probe 52 within the containment space between the baffle plate 22 and the tank bottom 14. As can be seen, the probe 52 is suspended above the top surface 18 of tank bottom 14. A compartment 71 is formed between the area of the structural member 73 and the top surface 18 of tank bottom 14. In the embodiment of FIG. 7, the structural member 73 is a semi-cylindrical member having one end 75 welded to the top surface 18 of tank bottom 14. The other end 77 is also welded, at a different location, to the top surface 18 of tank bottom 14.

FIG. 8 illustrates another alternative arrangement of the structural member 73 which shows, in particular, a support around the probe 52. As can be seen, a first vertical wall 79 is fastened at one side to the top surface 18 of tank bottom 14 and is fastened at the other side to the bottom surface 23B of baffle plate 22. Similarly, on the other side of the probe 52 is a second vertical wall 81 that is also fastened at one end to the bottom surface 23B of baffle plate 22 and to the top surface 18 of tank bottom 14. As such, these vertical walls 79 and 81 add to the structural support of the baffle plate 22 while serving to isolate the probe 52 from the aggregate material in the containment space of the tank system 10 of the present invention. The compartment 71 is formed between the walls 79 and 81 for the purpose of isolating the probe 52.

As described in more detail below, the containment space, in normal operation, is to be free of the material stored in the tank body 11. To purge the containment space of air or other materials that might otherwise interfere with the operation of the leak detection means 50, the present invention also includes purging the containment space with, for example, nitrogen. FIG. 9 depicts a partial cross-sectional elevational view along line D—D of FIG. 2. A fill valve 70, outside the tank, suitable for attachment to an exterior source of gas for purging the containment space (as described in more detail below), connects to a pipe 72 extending into a nipple 74 that is inserted and secured in a hole through the shell 12. The nipple 74 is secured to the hole in the shell 12 by a circumferential weld 78 that seals between the exterior periphery of the nipple 74 and the outside of the shell 12 to provide a leak-proof connection from the containment space inside the shell 12, through the nipple 74, through the pipe 72, and into the fill valve 70. The fill valve 70 can thus be connected to an external source of nitrogen (not shown), for example, for purging it of air and filling it with nitrogen. Nitrogen can be utilized as an effective means of corrosion control in the containment space. To aid in the process, with reference to FIG. 2, the embodiment depicted includes two valves 76A and 76B. The valves 76A, 76B are connected to the containment space through the shell 12 in a fashion similar to that shown in FIG. 6 for the fill valve 70. In addition, the present invention can include a plurality of valves like fill valve 70 to facilitate the purging process and for introducing nitrogen for corrosion protection.

Referring again to FIG. 9, a primary containment means 80 is installed inside the tank body 11 within the shell 12 and above the baffle plate 22. The primary containment means 80 includes a liner 82 applied to the inside 28A of shell 12 and top side 23A of baffle plate 22. Some of the acceptable materials that are suitable for the purposes of forming the liner 82 of the present invention include phenolic, epoxy phenolic, vinyl ester, vinyl ester with glass roving, epoxy novalac, and epoxy with chopped fiberglass. As shown in FIG. 9, for abrupt changes in the interior surfaces of the tank body 11, such as where the interior of the shell 12 joins the upper surface 23A of the baffle plate 22, a layer of caulk 84 under the liner 82 provides a uniform and gradual transition over such irregular areas. Other location where such caulk 84 might be useful include the lap welds 30 shown in FIG. 3, as well as all other welded seams, bolt heads, or other projections on the interior of the tank body 11. The use of the primary containment means 80 is intended and preferable when stored material is corrosive. However, the use of the primary containment should not be construed as a limitation on the present invention.

The present invention permits installing the secondary containment and leak detection apparatus on new or existing tanks or vessels. The tank should be inspected and repaired to the extent necessary to ensure its pressure integrity. Before installing any aggregate 24 or other materials on the bottom 14, the bottom 14 should be thoroughly inspected.

Next, for an existing tank body 11, to install the baffle plate 22, slots are cut into the shell of the tank to permit portions of the baffle plate 22 to be inserted through the wall of the shell 12. As shown in FIG. 3 and 9, the portions of the baffle plate 22 extending through the wall 12 are sealingly joined to the shell by means of a baffle interior weld 28A on top of the baffle plate 22 inside the shell 12, and two baffle exterior welds 28B, C on top and bottom, respectively, of the baffle plate 22 outside the shell 12. Preferably, the baffle plate 22 outside the shell 12 should be cut and ground smooth about the circumference of the tank body 11, as shown in FIG. 6. The individual portions that make up the complete baffle plate 22 should be laid in place and welded together with lap or butt welds 30, as shown in FIG. 3, to form a solid, continuous sealing surface across the interior of the tank body 11 and in continuous sealing contact around the inner periphery of the shell 12.

As described above and shown in the accompanying drawings, the present invention thus provides a secondary containment and leak detection system capable of satisfying EPA regulations. The tank body 11, including the shell 12, the baffle plate 22, and the bottom 14, forms a secondary containment system. This arrangement thus satisfies the requirement for a secondary containment system under the EPA regulations. In addition, the sealed containment space below the baffle plate 22 and above the bottom 14 provides for collecting and accumulating releases of materials from the primary containment means 80 within the tank body 11. The leak detection means 50 within the containment space enables rapid and effective detection of material that leaks from within the tank body 11 into the containment space. The containment space, normally filled with aggregate and nitrogen, or some other relatively inert gas, will receive material that might leak through the baffle plate 22. The leaked material will migrate throughout the containment space. The leak detection means 50, designed to detect whatever material is stored within the tank system 10, will immediately sense the presence of such material in its proximity within the containment space and send the appropriate signal through the connecting lines 60 to an alarm system, a control system, or some other device, thereby allowing detection of leaks.

The use of the aggregate material within the area between the baffle plate and the tank bottom of the present invention is very cost-effective. The aggregate serves as a structural support for the baffle plate. If any liquid should leak from the primary containment area of the tank system, then it will flow into the aggregate material within the containment space. As such, it is received and absorbed by the aggregate material. Eventually, it will be detected by the probe such that a signal is transmitted indicating the presence of a leak.

The use of the barrier surrounding the probe of the present invention prevents any damage from occurring to the probe by the intrusion of the aggregate material. The probe is maintained in its own compartment so that it can carry out its task of detecting leaks without interference from the contaminant-soaked aggregate. Additionally, the barrier used for isolating the probe can also be used to provide additional structural support to the baffle plate. As such, the present invention offers an inexpensive alternative to the invention, identified as U.S. Pat. No. 4,939,833, of the present inventor.

The present invention, therefore, for both new and existing installations, provides effective means of containing and detecting leaks of hazardous materials from tank storage systems, while being inexpensive and relying on proven technology.

Those skilled in the art will appreciate that the foregoing lists of attributes and advantages is not exhaustive of the features of the present invention. It will be appreciated that modifications to the described preferred embodiment of the invention can be made without departing from the substance and spirit of the present invention. In light of the foregoing, therefore, it will be seen that the scope of the present invention, as claimed below, exceeds that described in the preceding description of the preferred embodiment.

I claim:

1. An apparatus for holding stored material and for containing and detecting leaks of such stored material from the apparatus, comprising:

(a) A tank, including a tank bottom having a continuous surface for supporting such stored material, and further including a shell for surrounding such stored material, said shell being disposed above said continuous surface of said tank bottom and in continuous sealing connection therewith;

(b) Containment baffle means, including (i) a baffle plate having a continuous surface for supporting such stored material, said baffle plate being disposed above said tank bottom and within said shell, and said continuous surface of said baffle plate being in continuous sealing contact with said shell, thereby forming an air-purged containment space disposed between said baffle plate and said tank bottom; and (ii) wherein said baffle plate is supported above said tank bottom, said baffle plate supported by a fill of aggregate material contained within said containment space, said containment space filled with said aggregate material and a supply of an inert gas; and (c) Leak detection means arranged so as to detect the presence of such stored material within said containment space, said leak detection means connected to a device external of said tank for receiving electronic signals from said leak detection means relative to the presence of stored materials in said containment space.

2. The apparatus of claim 1, said aggregate material being a material selected from the group consisting of: sand, gravel, porous organic matter, and any combination thereof.

3. The apparatus of claim 1, said leak detection means comprising:

a probe responsive to the presence of said stored material within said containment space; and a barrier means positioned between said probe and said aggregate material in said containment space, said barrier means for separating said probe from said aggregate material, said barrier for permitting said probe to sense the presence of said stored material in said containment space.

4. The apparatus of claim 3, said barrier means comprising a mesh fastened to said probe so as to surround one end of said probe.

5. The apparatus of claim 3, said barrier means comprising:

a screen fastened to said baffle plate and fastened to said tank bottom, said screen defining a compartment within said containment space, said probe positioned within said compartment, said aggregate material on a side of said screen opposite said compartment.

6. The apparatus of claim 3, said barrier means comprising:

a structural member formed within said containment space, said structural member extending beyond an end of said probe, said structural member interposed between said baffle plate and said tank bottom; and a screen affixed to said structural member in a position beyond said end of said probe, said aggregate material on a side of said screen opposite said probe.

7. The apparatus of claim 6, further comprising:

a mesh fastened to said probe so as to surround said end of said probe.

8. The apparatus of claim 6, said structural member comprising a semi-cylindrical member affixed to a top surface of said tank bottom.

9. The apparatus of claim 6, said structural member comprising:

a first vertical wall fastened at one side to said tank bottom and fastened at another side to said baffle plate; and a second vertical wall fastened at one side to said tank bottom and fastened at another side to said baffle plate, said first and second vertical walls positioned on opposite sides of said probe.

10. The apparatus of claim 6, said structural member comprising:

a tubular casing extending around said probe, said tubular casing affixed at one end to said shell, said tubular casing extending outwardly from said shell.

11. A leak detection system for use relative to a containment space of a storage tank, said containment space having aggregate material contained therein, said system comprising:

a probe responsive to a presence of a stored material within said containment space;

a barrier means positioned between said probe and said aggregate material in said containment space, said barrier means for separating said probe from said aggregate material, said barrier for permitting said probe to sense the presence of said stored material, said barrier means comprising a screen fastened to said baffle plate and fastened to said tank bottom, said screen defining a compartment within said containment space, said probe positioned within said compartment, said aggregate material on a side of said screen opposite said compartment; and a control means connected to said probe of said containment space for receiving signals from said probe in relation to the presence of said stored material.

12. The system of claim 11, said barrier means comprising a mesh fastened to said probe so as to surround one end of said probe.

13. The system of claim 11, said barrier means comprising:

a structural member formed within said containment space, said structural member extending beyond an end of said probe, said tubular casing interposed between said baffle plate and said tank bottom; and a screen affixed to said structural member at a position beyond said end of said probe, said aggregate material on a side of said screen opposite said probe.

14. The system of claim 13, further comprising:

a mesh fastened to said probe so as to surround said end of said probe.

15. A method for modifying a tank to allow containing and detecting of leakage of stored material held in such tank, comprising the steps of:

(a) providing a tank having a tank bottom and a shell extending above said tank bottom, and being capable of containing such stored material inside said tank above said tank bottom and within said shell;

(b) placing a leak detection means in said tank, said leak detection means being capable of indicating the presence of such stored material;

(c) introducing a fill of an aggregate material onto said tank bottom;

(d) assembling a containment baffle in said tank within said shell above said leak detection means, said containment baffle including a continuous sealing surface in continuous sealing contact with said shell for sealingly isolating a space above said tank bottom and below said containment baffle, said fill of aggregate material positioned in said space between said tank bottom and said containment baffle, said aggregate material for supporting said containment baffle;

(e) introducing an inert gas into said space so as to purge said space of oxygen; and (f) sealing the oxygen-purged space so as to retain said inert gas therewithin.

16. The method of claim 15, further comprising the step of:

connecting said leak detection means to a device capable of receiving and responding to signals from said leak detection means.

17. The method of claim 16, said leak detection means comprising a device for detecting the presence of predetermined chemicals.

* * * * *